US010249239B2

(12) United States Patent
Wang

(10) Patent No.: US 10,249,239 B2
(45) Date of Patent: Apr. 2, 2019

(54) DRIVING CIRCUIT OF PIXEL UNIT AND DRIVING METHOD THEREOF, AND DISPLAY DEVICE

(71) Applicant: BOE TECHNOLOGY GROUP CO., LTD., Beijing (CN)

(72) Inventor: Ying Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 42 days.

(21) Appl. No.: 14/436,912

(22) PCT Filed: Sep. 17, 2014

(86) PCT No.: PCT/CN2014/086730
§ 371 (c)(1),
(2) Date: Apr. 20, 2015

(87) PCT Pub. No.: WO2015/172482
PCT Pub. Date: Nov. 19, 2015

(65) Prior Publication Data

US 2016/0125807 A1 May 5, 2016

(30) Foreign Application Priority Data

May 16, 2014 (CN) ..... 2014 1 0208648

(51) Int. Cl.
*G09G 3/00* (2006.01)
*G09G 3/32* (2016.01)
(Continued)

(52) U.S. Cl.
CPC ..... *G09G 3/3258* (2013.01); *G09G 3/3275* (2013.01); *G09G 2320/029* (2013.01);
(Continued)

(58) Field of Classification Search
CPC ..... G09G 3/3258; G09G 3/2092
See application file for complete search history.

(56) References Cited

U.S. PATENT DOCUMENTS 6,982,746 B1 * 1/2006 Kawahara ..... H04N 5/23248 348/208.1
7,193,370 B2 * 3/2007 Kim ..... G09G 3/3233 315/169.1
(Continued)

FOREIGN PATENT DOCUMENTS

CN 1633220 A 6/2005
CN 101800026 A 8/2010
(Continued)

OTHER PUBLICATIONS

Search report issued in international application No. PCT/CN2014/086730 dated Feb. 17, 2015 (Feb. 17, 2015).
(Continued)

*Primary Examiner* — Lin Li
(74) *Attorney, Agent, or Firm* — Nath, Goldberg & Meyer; Joshua B. Goldberg; Daniel Bissing

(57) ABSTRACT

The present invention provides a driving circuit of pixel unit and a driving method thereof, and a display device. The driving circuit of pixel unit is configured to drive sub-pixel units on a display panel, and comprises a driving power supply signal port connected to the sub-pixel units through power supply signal lines and at least one compensation unit. The driving power supply signal port is configured to transfer a driving voltage output from the driving power supply to each of the sub-pixel units through the power supply signal lines. The compensation unit is configured to perform real-time compensation on voltage drops on the power supply signal lines when the sub-pixel units display different gray levels.

17 Claims, 7 Drawing Sheets

(51) Int. Cl.

| | |
|---|---|
| ***G06F 3/038*** | (2013.01) |
| ***H05B 33/08*** | (2006.01) |
| ***G09G 3/3258*** | (2016.01) |
| ***G09G 3/3275*** | (2016.01) |

(52) U.S. Cl.
CPC ..... *G09G 2320/0223* (2013.01); *G09G 2320/0285* (2013.01)

(56) References Cited

U.S. PATENT DOCUMENTS 8,970,574 B2 * 3/2015 Kim ..... G09G 3/3233 345/204
9,351,368 B2 * 5/2016 Azizi ..... H05B 33/0848
2005/0052350 A1 * 3/2005 Mizukoshi ..... G09G 3/3233 345/55
2005/0062710 A1 3/2005 Kasai et al.
2006/0087247 A1 * 4/2006 Malmberg ..... G09G 3/006 315/169.2
2006/0208971 A1 * 9/2006 Deane ..... G09G 3/3233 345/76
2008/0238953 A1 * 10/2008 Ogura ..... G09G 3/3275 345/697
2009/0295423 A1 * 12/2009 Levey ..... G09G 3/006 324/760.01
2011/0205221 A1 * 8/2011 Lin ..... G09G 3/2092 345/213
2012/0044271 A1 2/2012 Lee et al.
2012/0068986 A1 * 3/2012 Mizutani ..... G09G 3/3225 345/211
2012/0120042 A1 * 5/2012 Tsai ..... G09G 3/3233 345/211
2012/0236041 A1 * 9/2012 Oh ..... G09G 3/3258 345/690
2012/0249510 A1 10/2012 Jankovic et al.
2012/0274622 A1 * 11/2012 Huang ..... G09G 3/3233 345/212
2012/0293481 A1 * 11/2012 Chaji ..... G06F 3/038 345/212
2013/0127932 A1 5/2013 Ham
2013/0314394 A1 * 11/2013 Chaji ..... G09G 3/00 345/212
2015/0021598 A1 * 1/2015 Ikeda ..... H01L 27/1225 257/43

FOREIGN PATENT DOCUMENTS

CN 101976546 A 2/2011
CN 102646386 A 8/2012
CN 102959611 A 3/2013
CN 103268755 A 8/2013
CN 103383835 A 11/2013
CN 104036722 A 9/2014
WO WO 2004/034364 * 4/2004 ..... G09G 3/30
WO WO 2004/034364 A1 * 4/2004 ..... G09G 3/3233

OTHER PUBLICATIONS

Office Action dated Sep. 6, 2015 issued in corresponding Chinese Application No. 201410208648.8.

* cited by examiner

DRAWINGS

DRIVING CIRCUIT OF PIXEL UNIT AND DRIVING METHOD THEREOF, AND DISPLAY DEVICE

This is a National Phase Application filed under 35 U.S.C. 371 as a national stage of PCT/CN2014/086730, filed Sep. 17, 2014, an application claiming the benefit of Chinese Application No. 201410208648.8, filed May 16, 2014, the content of each of which is hereby incorporated by reference in its entirety.

FIELD OF THE INVENTION

The present invention belongs to the technical field of organic electroluminescent display, and particularly relates to a driving circuit of pixel unit and a driving method thereof, and a display device.

BACKGROUND OF THE INVENTION

In comparison to a thin film transistor liquid crystal display (TFT-LCD) serving as a mainstream display technology at present, an organic light emitting diode (OLED) display has advantages of wide angle of view, high brightness, high contrast ratio, low energy consumption, lightness, thinness and the like, and thus becomes a focus of the present flat panel display technology.

The driving methods for organic light emitting diode displays are classified into two categories: a passive matrix (PM) type and an active matrix (AM) type. In comparison to the passive matrix type driving, the active matrix type diving has advantages of large amount of displayed information, low power consumption, long service life of devices, high contrast ratio of pictures and the like. An equivalent circuit of the basic principle of a driving circuit of pixel unit for an active matrix type organic light emitting diode display in the prior art is as shown in FIG. 1, comprising: a switch transistor M1, a driving transistor M2, a storage capacitor C1 and an organic electroluminescent device D1. The drain of the switch transistor M1 is connected to the gate of the driving transistor M2. The gate of the driving transistor M2 is also connected to one end of the storage capacitor C1, the source thereof is connected to the other end of the storage capacitor C1, and the drain thereof is connected to the luminescent device D1. When the gate of the switch transistor M1 is strobed by a scanning signal Vscan(n), the switch transistor M1 is turned on to import a data signal Vdata from the source thereof. The driving transistor M2 generally works in a saturation area. The gate-source voltage $Vgs,_{DTFT}$ of the driving transistor M2 determines the magnitude of the current flowing through the driving transistor M2, so that the stable current is provided for the luminescent device D1. $Vgs,_{DTFT}$=VDD-Vdata (where the driving transistor M2 is a P type transistor), and the VDD is a voltage-stabilization or current-stabilization driving voltage connected to the driving transistor M2 for providing the energy required for the luminescence of the OLED device D1. The storage capacitor C1 functions as keeping the gate voltage of the driving transistor M2 stable within one frame.

The inventor has found at least the following problems in the prior art: the current actually flowing through the OLED device is:

$$I_{OLED} = \frac{1}{2}\mu Cox(W/L)(|Vgs_{,DTFT}| - |Vth|)^2$$

-continued $$= \frac{1}{2}\mu Cox(W/L)(Vdd - V_{IRdrop} - Vdata - Vth)^2.$$

Since the IR drop on a power supply signal line between the driving voltage VDD and the GND (the power supply signal line itself has a resistance, so there is a voltage drop, i.e., an IR drop, on the power supply signal line), the current provided to the OLED device will be influenced by the IR drop, so that an operating point achieving white balance will drift, and the change in the current will influence the distribution of the driving voltage VDD and the magnitude of the IR drop again. Accordingly, a dynamic interaction process is formed, and the problem of non-uniform display is caused.

SUMMARY OF THE INVENTION

In view of the problems in the existing driving circuit of pixel unit, a technical problem to be solved by the present invention is to provide a driving circuit of pixel unit capable of making the display effect of a display device more uniform and a driving method thereof, an array substrate and a display device.

The present invention provides a driving circuit of pixel unit configured to drive sub-pixel units on a display panel, the driving circuit of pixel unit comprises a driving power supply signal port connected to the sub-pixel units through power supply signal lines, the driving power supply signal port is configured to transfer a driving voltage output from the driving power supply to each of the sub-pixel units through the power supply signal lines, the driving circuit of pixel unit further comprises at least one compensation unit configured to perform real-time compensation on voltage drops on the power supply signal lines when the sub-pixel units display different gray levels.

As the power supply signal lines for connecting the pixel units to the driving power supply signal port have certain resistances, certain voltage drops will be inevitably generated on the power supply signal lines when the sub-pixel units perform display. For displaying different gray levels, the data voltage of the sub-pixel units will be changed (it can be seen from the current formula of the pixel unit in the prior art), thus the voltage drops on the power supply signal lines while displaying different gray levels will also be changed. The driving circuit of pixel unit of the present invention is additionally provided with a compensation unit, and the compensation unit may perform real-time compensation on the voltage drops on the power supply signal lines when the sub-pixel units display different gray levels. In other words, the compensation unit provides a particular compensating voltage to compensate the voltage drops on the power supply signal lines when the sub-pixel units display a certain gray level brightness. During displaying of different gray levels, the corresponding compensating voltage provided by the compensation unit is also different, so that the display may be allowed to be more uniform.

The driving circuit of pixel unit comprises a plurality of pixel regions, each of the pixel regions comprises a plurality of sub-pixel units; and the compensation unit is configured to acquire an average value of the currents on at least part of the power supply signal lines according to the detected current values on the at least part of the power supply signal lines in the pixel regions, and then convert the average value of the currents into a compensating voltage for compensating the voltage drop on each of the power supply signal lines in the pixel regions.

For example, the driving circuit of pixel unit may further comprise a plurality of current sampling units, each of the pixel regions is provided with a plurality of current sampling units therein; and the compensation unit comprises a controller unit electrically connected to the current sampling units. The current sampling units are configured to detect the currents on at least part of the power supply signal lines in the pixel regions and transfer the detected current values to the controller unit. The controller unit is configured to operate the current values detected by the current sampling units to obtain an average value of the currents on the detected power supply signal lines in the pixel regions, and then convert the average value of the currents into a corresponding compensating voltage for compensating the voltage drops on all the power supply signal lines in the pixel regions.

Alternatively, the driving circuit of pixel unit may further comprise a plurality of current sampling units, each of the pixel regions is provided with at least one of the current sampling unit therein; and the compensation unit comprises a controller unit electrically connected to the current sampling units. The current sampling units are configured to detect the currents on at least part of the power supply signal lines in the pixel regions and transfer the detected current values to the controller unit. The controller unit is configured to operate the current values detected by the current sampling units disposed in the pixel regions and the current values detected by the current sampling units disposed near the pixel regions to obtain an average value of the currents on the detected power supply signal lines, and then convert the average value of the currents into a corresponding compensating voltage for compensating the voltage drops on all the power supply signal lines in the pixel regions.

The compensation unit may further comprise an analog-to-digital conversion unit and a digital-to-analog conversion unit. The analog-to-digital conversion unit is connected between the current sampling units and the controller unit and configured to convert the current values detected by the current sampling units into digital values and then transfer the digital values to the controller unit. The digital-to-analog conversion unit is connected between the controller unit and the power supply signal lines and configured to convert the digital average value of the currents operated by the controller unit into the analog compensating voltage for compensating the voltage drops on the power supply signal lines.

The controller unit may be a microprocessor or a programmable logic device.

The pixel unit driving unit may further comprise current lead lines, and each of the sub-pixel units at least comprises a driving transistor and an organic electroluminescent device connected to the drain of the driving transistor through the power supply signal line. The driving transistors are disposed on a substrate. The current lead lines are disposed below the driving transistors, connected to the compensation unit and configured to feed back the current output from the drains of the driving transistors to the compensation unit. The compensation unit compensates the voltage drops on the power supply signal lines according to the value of the current.

The present invention further provides a driving method of a driving circuit of pixel unit, the driving circuit of pixel unit being configured to drive sub-pixel units on a display panel and comprising a driving power supply signal port connected to the sub-pixel units through power supply signal lines and at least one compensation unit, the driving power supply signal port being configured to transfer a driving voltage output from a driving power supply to each of the sub-pixel units through the power supply signal lines, the driving method of the driving circuit of pixel unit comprises: performing, by the compensation unit, real-time compensation on voltage drops on the power supply signal lines for connecting the driving power supply signal port to the sub-pixel units when the sub-pixel units display different gray levels.

The display panel driven by the driving circuit of pixel unit comprises a plurality of pixel regions, each of the pixel regions comprises a plurality of sub-pixel units. The step of performing, by the compensation unit, real-time compensation on voltage drops on the power supply signal lines for connecting the driving power supply signal port to the sub-pixel units when the sub-pixel units display different gray levels includes: acquiring, by the compensation unit, an average value of the currents on at least part of the power supply signal lines according to the currents on the at least part of the power supply signal lines in each of the pixel regions, and then converting the average value of the currents into a compensating voltage for compensating the voltage drop on each of the power supply signal lines in the pixel regions.

For example, the driving circuit of pixel unit comprises a plurality of current sampling units, each of the pixel regions is provided with a plurality of current sampling units therein; and the compensation unit comprises a controller unit electrically connected to the current sampling units. The step of performing, by the compensation unit, real-time compensation on voltage drops on the power supply signal lines for connecting the driving power supply signal port to the sub-pixel units when the sub-pixel units display different gray levels includes: detecting, by the current sampling units, current values on at least part of the power supply signal lines in the pixel regions and transferring the detected current values to the controller unit; and operating, by the controller unit, the current values detected by the current sampling units disposed in the pixel regions to obtain an average value of the currents on the detected power supply signal lines in the pixel regions, and then converting the average value of the currents into a corresponding compensating voltage for compensating the voltage drop on each of the power supply signal lines in the pixel regions.

Alternatively, the driving circuit of pixel unit comprises a plurality of current sampling units, each of the pixel regions is provided with at least one current sampling unit therein; and the compensation unit comprises a controller unit electrically connected to the current sampling units. The step of performing, by the compensation unit, real-time compensation on voltage drops on the power supply signal lines for connecting the driving power supply signal port to the sub-pixel units when the sub-pixel units display different gray levels includes: detecting, by the current sampling units, current values on at least part of the power supply signal lines in the pixel regions and transferring the detected current values to the controller unit; and operating, by the controller unit, the current values detected by the current sampling units disposed in the pixel regions and the current values detected by the current sampling units disposed near the pixel regions to obtain an average value of the currents on the detected power supply signal lines, and then converting the average value of the currents into a corresponding compensating voltage for compensating the voltage drop on each of the power supply signal lines in the pixel regions.

The compensation unit may further comprise: an analog-to-digital conversion unit connected between the current sampling units and the controller unit, and a digital-to-analog conversion unit connected between the controller unit and the power supply signal lines. The step of detecting, by the current sampling units, current values on at least part of the power supply signal lines and transferring the detected current values to the controller unit includes: detecting, by the current sampling units, current values on at least part of the power supply signal lines, and converting, by the analog-to-digital conversion unit, the current values into digital values and transferring the digital values to the controller unit. The step of providing, by the controller unit, a corresponding compensating voltage according to the current signals detected by the current sampling units for compensating the voltage drops on the power supply signal lines includes: operating, by the controller unit, the received digital current values to obtain a digital average value of the currents on all the power supply signal lines in the pixel regions, and then converting, by the digital-to-analog conversion unit, the digital average value of the currents into an analog compensating voltage for compensating the voltage drops on the power supply signal lines.

The present invention further provides a display device, comprising a plurality of sub-pixel units, a driving power supply, and the driving circuit of pixel unit described above. The driving power supply is electrically connected to the sub-pixel units through power supply signal lines and configured to provide a driving voltage to the sub-pixel units through the power supply signal lines. The driving circuit of pixel unit is connected to the power supply signal lines through a driving power supply signal port provided thereon, and configured to process the driving voltage output from the driving power supply, then output the processed driving voltage to the power supply signal lines through the driving power supply signal port and further transfer the processed driving voltage to each of the sub-pixel units so as to provide a driving signal to each of the sub-pixel units. The compensation unit in the driving circuit of pixel unit is configured to perform real-time compensation on voltage drops on the power supply signal lines when the sub-pixel units display different gray levels so as to provide the compensated driving voltage to each of the sub-pixel units.

DETAILED DESCRIPTION OF THE EMBODIMENTS

To make those skilled in the art better understand the technical solutions of the present invention, the present invention will be further described as below in details with reference to the drawings and specific implementations.

First Embodiment

Figure 1:
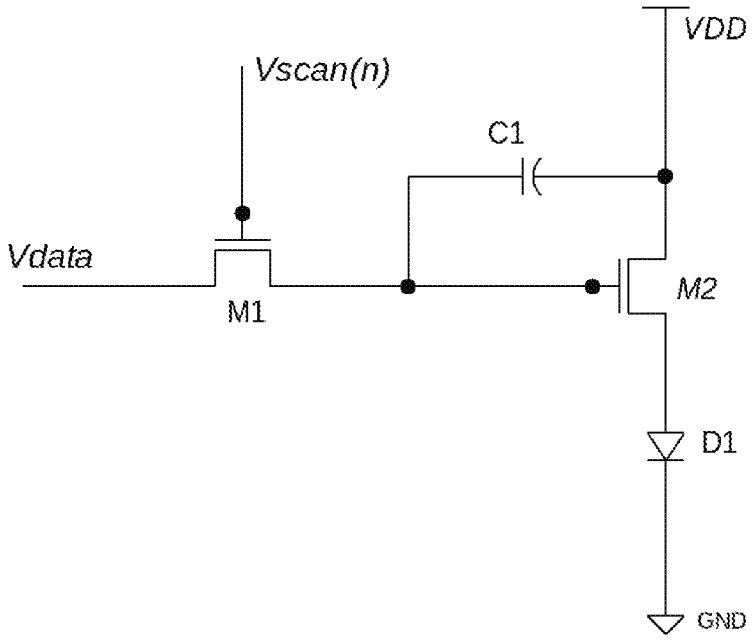
FIG. 1 is an equivalent circuit diagram of basic principle of a driving circuit of pixel unit for an organic light emitting display in the prior art.
Figure 2:
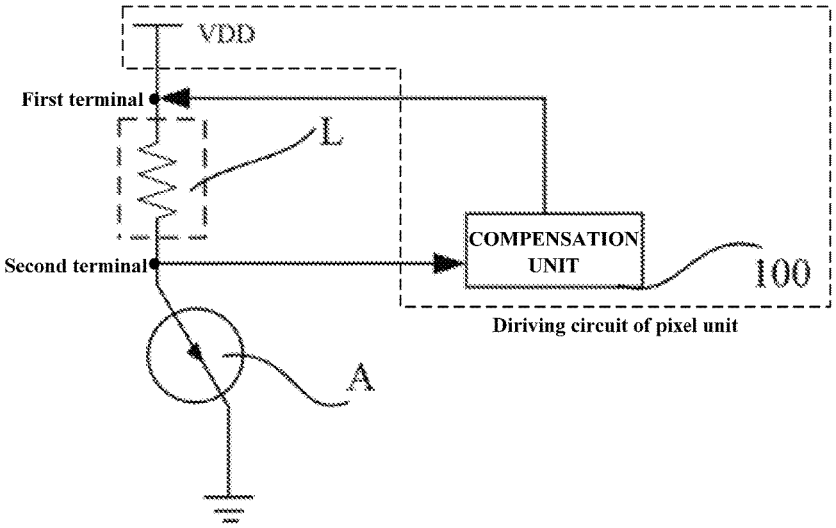
FIG. 2 is a simple schematic diagram of a driving circuit of pixel unit according to a first embodiment of the present invention.
Figure 3:
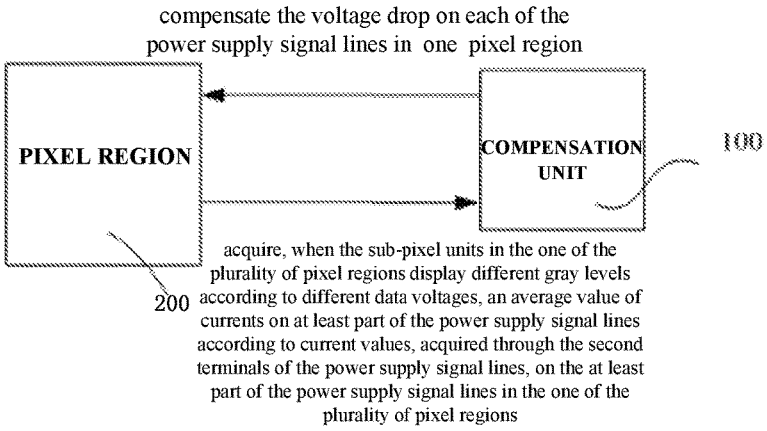
FIG. 3 is another simple schematic diagram of the driving circuit of pixel unit according to the first embodiment of the present invention.
Figure 4:
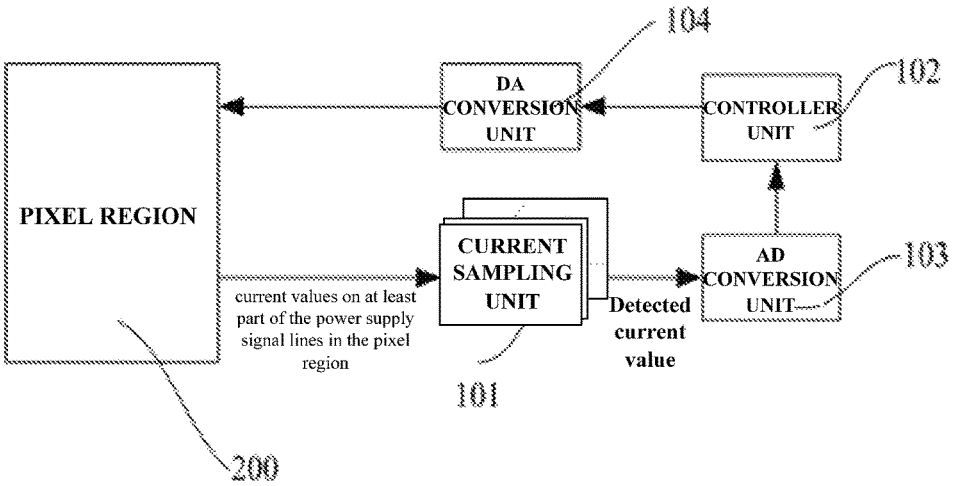
FIG. 4 is a schematic diagram of the driving circuit of pixel unit according to the first embodiment of the present invention.

Referring to FIGS. 2 through 4, this embodiment provides a driving circuit of pixel unit configured to drive sub-pixel units A on a display panel. The driving circuit of pixel unit comprises a driving power supply signal port connected to the pixel units via power supply signal lines L, and at least one compensation unit 100. The driving power supply signal port is configured to transfer a driving voltage VDD output from a driving power supply to each of the sub-pixel units A via the power supply signal lines L. The compensation unit 100 is configured to perform real-time compensation on voltage drops on the power supply signal lines when the sub-pixel units A perform display.

As the power supply signal lines L for connecting the pixel units to the driving power supply signal port have certain resistances (shown by a dashed frame in FIG. 2), certain voltage drops will be inevitably generated on the power supply signal lines L when the sub-pixel units A perform display. For displaying different gray levels, the data voltage of the sub-pixel units A will be changed (it can be seen from the current formula of the pixel unit in the prior art), thus the voltage drops on the power supply signal lines L while displaying different gray levels will also be changed. In this embodiment, the compensation unit 100 is additionally provided, and the compensation unit 100 may perform real-time compensation on the voltage drops on the power supply signal lines L when the sub-pixel units A display different gray levels. In other words, the compensation unit 100 provides a particular compensating voltage to compensate the voltage drops on the power supply signal lines L when the sub-pixel units A display a certain gray level brightness. During displaying of different gray levels, the corresponding compensating voltage provided by the compensation unit 100 is also different, so that the display may be allowed to be more uniform.

As there may be many sub-pixel units A in the driving circuit of pixel unit, for example, the display panel driven by the driving circuit of pixel unit is divided into a plurality of pixel regions 200. As shown in FIG. 3, each of the pixel regions 200 comprises a plurality of sub-pixel units A. The compensation unit 100 is configured to acquire an average value of the currents on the detected power supply signal lines L according to the detected currents on at least part of the power supply signal lines L in each of the pixel regions 200, and then convert the average value of the currents into a compensating voltage for compensating the voltage drop on each of the power supply signal lines L in this pixel region 200. In other words, all the power supply signal lines L in each of the pixel regions 200 are voltage-compensated by one compensation unit 100. In this case, the voltage drops on all the power supply signal lines L in each of the pixel regions 200 may be evenly compensated, and meanwhile in comparison to the case in which each of the sub-pixel units A is provided with one compensation unit 100, the cost may be greatly saved, the structure of the driving circuit of pixel unit is relatively simple and easy to be implemented.

It should be understood that, in the driving circuit of pixel unit provided by this embodiment, each of the sub-pixel units A may also correspond to one compensation unit 100, as shown in FIG. 2. In this case, the compensation for the voltage on each of the power supply signal lines L may be more accurate, but this arrangement mode will result in high cost and is difficult to be implemented.

For example, as shown in FIG. 4, as one situation of this embodiment, the driving circuit of pixel unit further comprises a plurality of current sampling units 101, and each of the pixel regions 200 is provided with a plurality of current sampling units 101 therein. The compensation unit 100 comprises a controller unit 102 electrically connected to the current sampling units 101. The plurality of current sampling units 101 are connected to at least part of the power supply signal lines L in the pixel regions 200, and configured to detect current values on the power supply signal lines L connected thereto in the pixel regions 200 and transfer the current values to the controller unit 102. The controller unit 102 is configured to operate the current values detected by the current sampling units 101 to acquire an average value of all the currents on the detected power supply signal lines L in the pixel regions 200 and then convert the average value of the currents into a corresponding compensating voltage for compensating the voltage drops on the power supply signal lines L.

As another situation of this embodiment, the driving circuit of pixel unit further comprises a plurality of current sampling units 101, and each of the pixel regions 200 is provided with at least one current sampling unit 101 therein. The compensation unit 100 comprises a controller unit 102 electrically connected to the current sampling units 101. The current sampling units 101 are configured to detect currents on at least part of the power supply signal lines L in the pixel regions 200 and transfer the detected current values to the controller unit 102. The controller unit 102 is configured to operate the current values detected by the current sampling units 101 disposed in the pixel regions 200 and the current values detected by the current sampling units 101 disposed near the pixel regions 200 to obtain an average value of the currents on the detected power supply signal lines L and then convert the average value of the currents into a corresponding compensating voltage for compensating the voltage drops on all the power supply signal lines L in the pixel regions 200.

Figure 5:
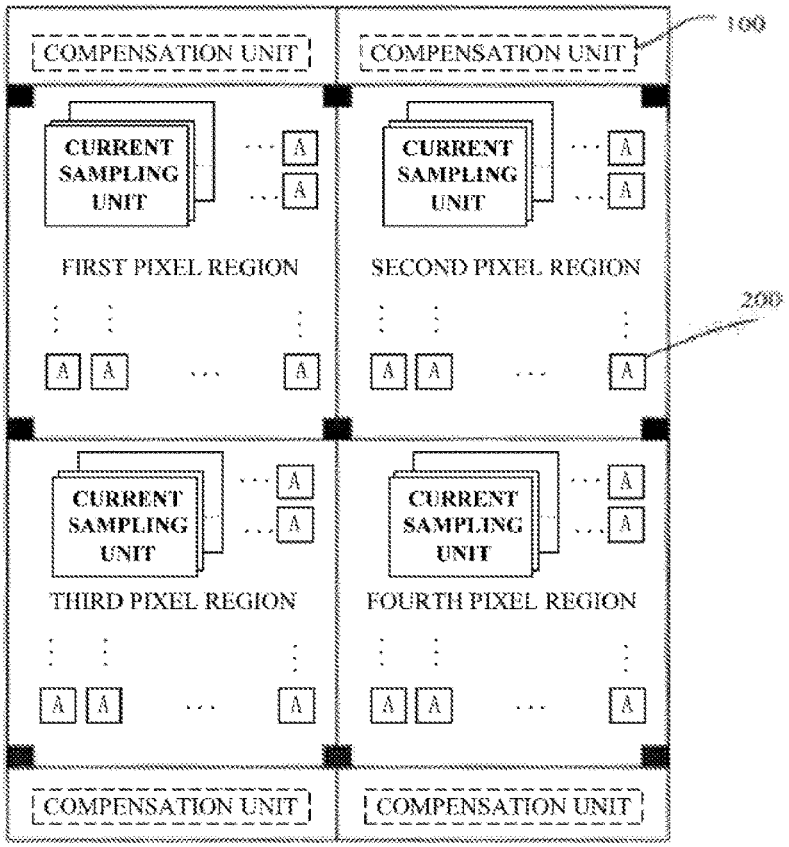
FIG. 5 is a schematic diagram of a 9-point sampling method in the driving circuit of pixel unit according to the first embodiment of the present invention.

Specifically, as shown in FIG. 5, the display panel driven by the driving circuit of pixel unit comprises four pixel regions (i.e., a first pixel region, a second pixel region, a third pixel region and a fourth pixel region) and nine current sampling units 101. Namely, the voltage drops on all the power supply signal lines L are compensated by a 9-point sampling method.

For example, two current sampling units 101 are provided at an upper left vertex and a lower left vertex of the first pixel region (i.e., an upper left region), and two current sampling units 101 are provided near an upper right vertex and a lower right vertex of this pixel region. In view of this pixel region, the currents on at least part of the power supply signal lines L are sampled by the two current sampling units 101 disposed in this pixel region and the two current sampling units 101 disposed near this pixel region, and an averaging operation is performed by the controller unit 102 on the current values detected by the four current sampling units 101 to acquire an average current value. The controller unit 102 provides a compensating voltage according to the average current value so as to compensate the voltage drop on each of the power supply signal lines L in this pixel region 200.

For example, two current sampling units 101 are provided at an upper right vertex and a lower right vertex of the second pixel region (i.e., an upper right region), and two current sampling units 101 are provided near an upper left vertex and a lower left vertex of this pixel region. In view of the voltage drop on each of the power supply signal lines L in this pixel region, based on the currents on at least part of the power supply signal lines L detected by the two current sampling units 101 disposed near this pixel region and the currents on at least part of the power supply signal lines L in this pixel region 200 detected by the two current sampling units 101 disposed in this pixel region, an averaging operation may be performed by the controller unit 102 to acquire an average current value. The controller unit 102 provides a compensating voltage according to the average current value so as to compensate the voltage drop on each of the power supply signal lines L in this pixel region 200.

In a similar way, the voltage drops on all the power supply signal lines L in the third pixel region (i.e., a lower left region) and the fourth pixel region (i.e., a lower right region) may be compensated.

In addition, the compensation unit 100 in this embodiment may further comprise an analog-to-digital conversion unit 103 and a digital-to-analog conversion unit 104. The analog-to-digital conversion unit 103 is connected between the current sampling unit 101 and the controller unit 102 and configured to convert the current value detected by the current sampling unit 101 into a digital value and then transfer the digital value to the controller unit 102. The digital-to-analog conversion unit 104 is connected between the controller unit 102 and the power supply signal lines L and configured to convert the digital average value of the currents operated by the controller unit 102 into an analog compensating voltage for compensating the voltage drops on the power supply signal lines L.

The controller unit 102 in this embodiment may be a microprocessor (MPU) or a programmable logic device (FPGA), and may be any other component with function of a controller.

In this embodiment, for example, the driving circuit of pixel unit is divided into a plurality of pixel regions 200, and each of the pixel regions 200 corresponds to one compensation unit 100 for compensating the voltage drop on each of the power supply signal lines L in each of the pixel regions 200, so that the display effect is more uniform.

In addition, the driving circuit of pixel unit provided by this embodiment may further comprise current lead lines S, and each of the sub-pixel units at least comprises a driving transistor and an organic electroluminescent device connected to the drain of the driving transistor. The driving transistors are disposed on a substrate. The current lead lines S are disposed below the driving transistors, and the current lead lines S are connected to the compensation unit and configured to feed back the current output from the drains 8-2 of the driving transistors to the compensation unit 100. The compensation unit 100 compensates the voltage drops on the power supply signal lines L according to the value of the current.

Figure 6:
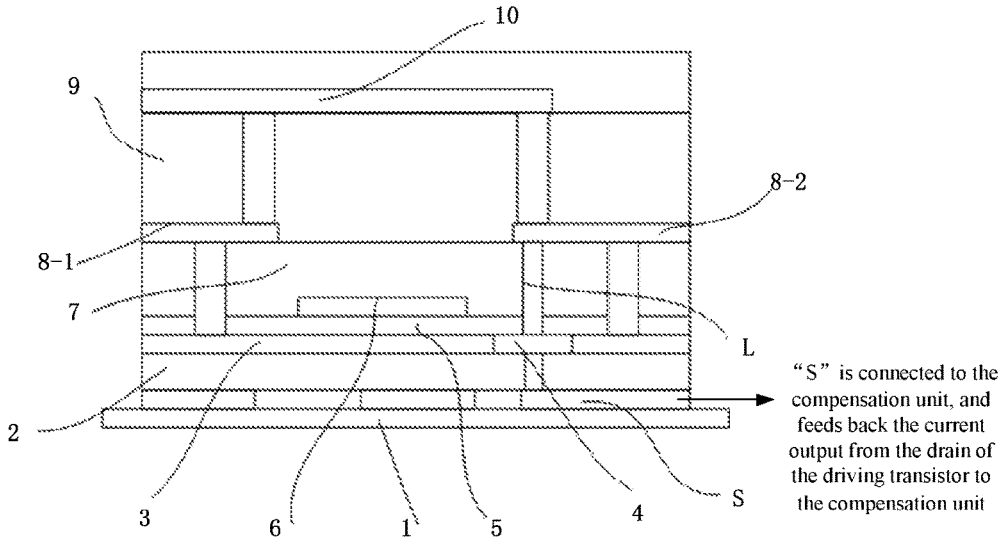
FIG. 6 is a cross-sectional diagram in the driving circuit of pixel unit according to the first embodiment of the present invention.
Figure 7:
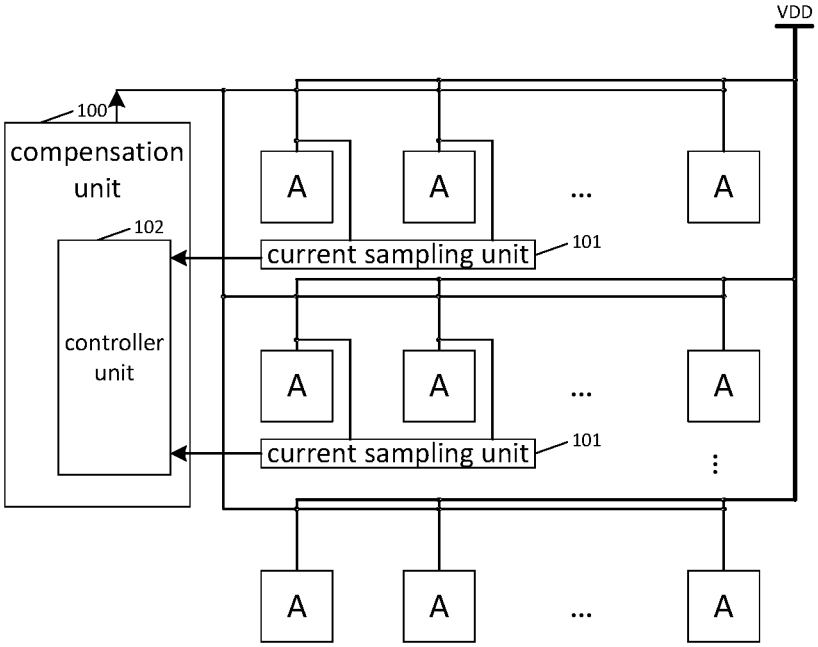
FIG. 7 is a wiring diagram of a pixel region according to an embodiment of the present invention.
Figure 8:
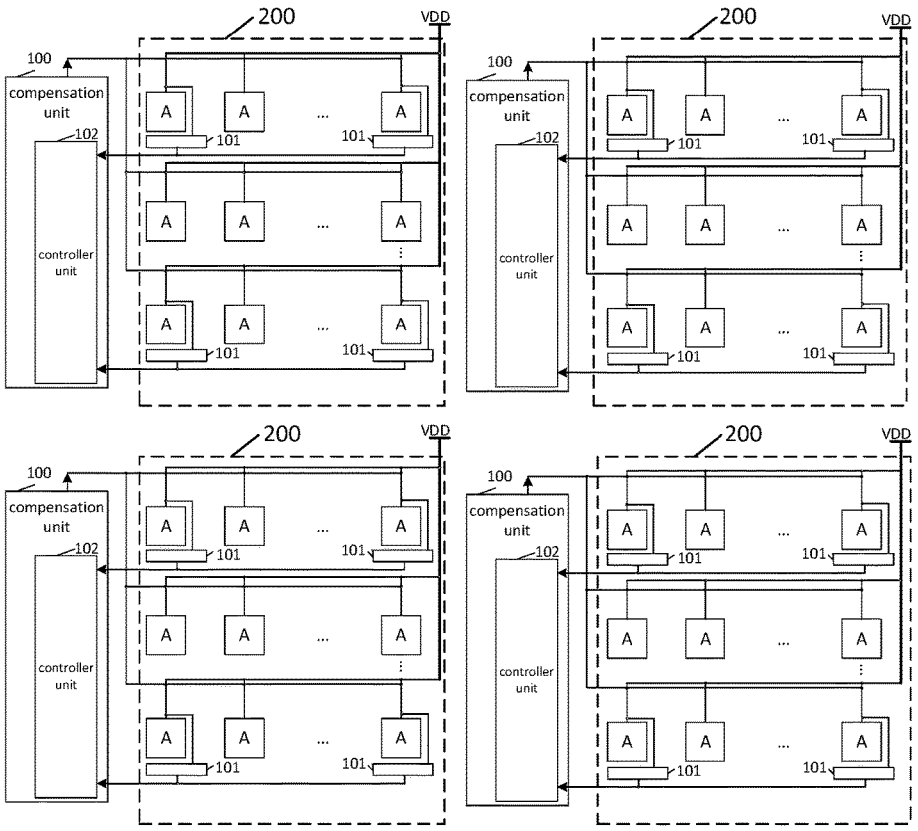
FIG. 8 is a wiring diagram of a pixel unit according to an embodiment of the present invention.
Figure 9A:
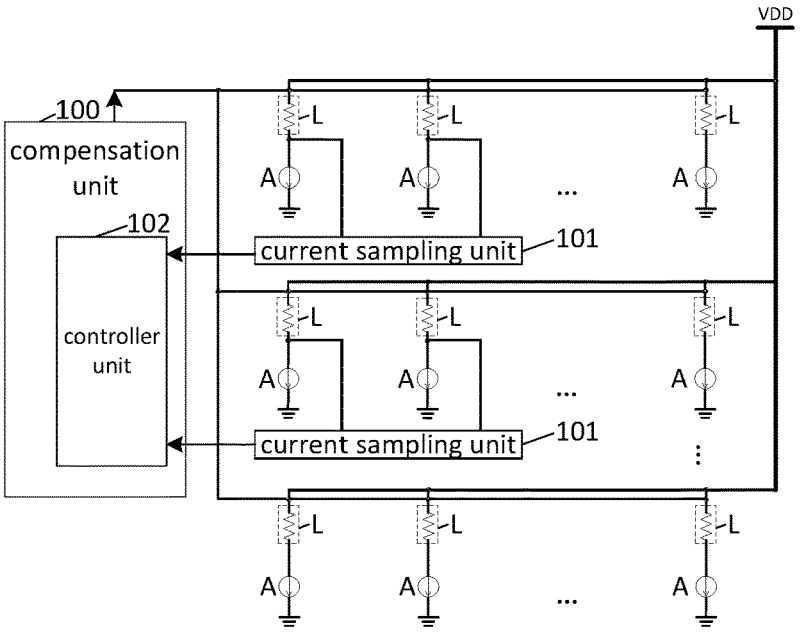
FIG. 9A is a circuit diagram of a pixel region according to an embodiment of the present invention.
Figure 9B:
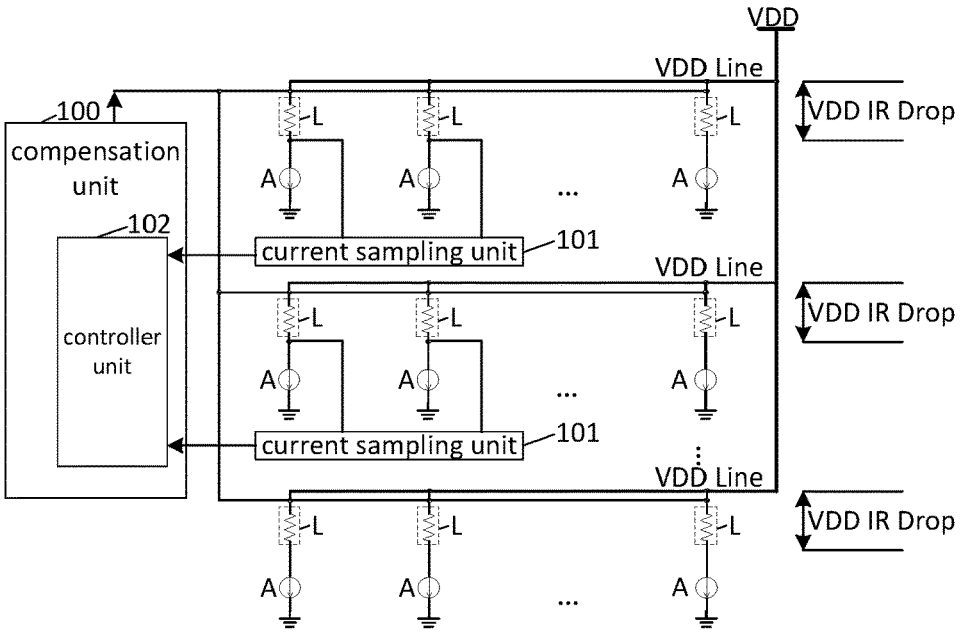
FIG. 9B is circuit diagram of a pixel region, including associated voltage drops, according to an embodiment of the present invention.

Specifically, as shown in FIG. 6, taking the sub-pixel units A comprising driving transistors made of low temperature polycrystalline silicon as an example, the driving circuit of pixel unit specifically comprises the current lead line S disposed on a substrate 1, and a buffer layer 2, an active layer 3 of the driving transistor (including a polycrystalline silicon doped region 4), a gate insulating layer 5, a gate 6, a planarization layer 7, a source 8-1, a drain 8-2, a passivation layer 9 and pixel electrodes 10 which are sequentially formed above the current lead line S. The source 8-1 and the drain 8-2 are respectively connected to the active layer 3 through first via holes penetrating through the gate insulating layer 5 and the planarization layer 6. The current lead line S are connected to the drain 8-2 and configured to transfer the current output from the power supply signal lines to the compensation unit. As the current is transferred to the organic electroluminescent device (the pixel electrode 10 serves as the anode of the organic electroluminescent device) through the power supply signal line via the drain 8-2 of the driving transistor, the current of the drain 8-2 is the current subjected to the voltage drop generated on the power supply signal line, and then the compensation unit compensates the voltage drop on the power supply signal line according to this current. In this case, as the current lead line S is disposed below the buffer layer, the problem of difficult wiring due to the large density of the sub-pixel units in a high-resolution display panel is solved.

Second Embodiment

This embodiment provides a driving method of a driving circuit of pixel unit. The driving circuit of pixel unit is configured to drive sub-pixel units A on a display panel, and comprises a driving power supply signal port connected to the sub-pixel units A through power supply signal lines L and at least one compensation unit 100. The driving power supply signal port is configured to transfer a driving voltage output from a driving power supply to each of the sub-pixel units A through the power supply signal lines L. The driving circuit of pixel unit may also be the driving circuit of pixel unit provided by the first embodiment. The driving method provided by this embodiment comprises: performing, by the compensation unit 100, real-time compensation on voltage drops on the power supply signal lines L for connecting the driving power supply signal port to the sub-pixel units A when the sub-pixel units A display different gray levels.

As the voltage drops on the power supply signal lines L are compensated in real time in the driving method of a driving circuit of pixel unit provided by this embodiment, the display effect may be better and more uniform.

For example, the display panel driven by the driving circuit of pixel unit in this embodiment comprises a plurality of pixel regions 200, and each of the pixel regions 200 comprises a plurality of sub-pixel units A.

In the driving method, the step of performing, by the compensation unit 100, real-time compensation on voltage drops on the power supply signal lines L for connecting the driving power supply signal port to the sub-pixel units A when the sub-pixel units display different gray levels includes: acquiring, by the compensation unit 100, an average value of the currents on at least part of the power supply signal lines L according to the currents on the at least part of the power supply signal lines L in each of the pixel regions 200, and then converting the average value of the currents into a compensating voltage for compensating the voltage drop on each of the power supply signal lines L in the pixel regions 200.

For example, as one situation of this embodiment, the driving circuit of pixel unit further comprises a plurality of current sampling units 101, and each of the pixel regions 200 is provided with a plurality of current sampling units 101 therein. The compensation unit 100 comprises a controller unit 102 electrically connected to the current sampling units 101.

In this case, the step of performing, by the compensation unit 100, real-time compensation on voltage drops on the power supply signal lines L for connecting the driving power supply signal port to the sub-pixel units A when the sub-pixel units A display different gray levels includes: detecting, by the current sampling units 101, current values on at least part of the power supply signal lines L in the pixel region 200 and transferring the current values to the controller unit 102; and operating, by the controller unit 102, the current values detected by the current sampling units 101 disposed in the pixel region 200 to obtain an average value of the currents on the at least part of the power supply signal lines L in the pixel region 200, and then converting the average value of the currents into a corresponding compensating voltage for compensating the voltage drop on each of the power supply signal lines L in the pixel region 200.

In addition, as another situation of this embodiment, the driving circuit of pixel unit further comprises a plurality of current sampling units 101, and each of the pixel regions 200 is provided with at least one current sampling unit 101 therein. The compensation unit 100 comprises a controller unit 102 electrically connected to the current sampling units 101.

In this case, the step of performing, by the compensation unit 100, real-time compensation on voltage drops on the power supply signal lines L for connecting the driving power supply signal port to the sub-pixel units A when the sub-pixel units A display different gray levels includes: detecting, by the current sampling units 101, currents on at least part of the power supply signal lines L in the pixel region 200 and transferring the detected current values to the controller unit 102; and operating, by the controller unit 102, the current values detected by the current sampling units 101 disposed in the pixel region 200 and the current values detected by the current sampling units 101 disposed near the pixel region 200 to obtain an average value of the currents on the detected power supply signal lines L, and then converting the average value of the currents into a corresponding compensating voltage for compensating the voltage drops on all the power supply signal lines L in the pixel region 200.

In addition, the compensation unit 100 may further comprise: an analog-to-digital conversion unit 103 connected between the current sampling units 101 and the controller unit 102, and a digital-to-analog conversion unit 104 connected between the controller unit 102 and the power supply signal lines L. Correspondingly, the driving method comprises: detecting, by the current sampling units 101, current values on at least part of the power supply signal lines L, and converting, by the analog-to-digital conversion unit 103, the current values into digital values and transferring the digital values to the controller unit 102; and operating, by the controller unit 102, the received digital current values to obtain a digital average value of the currents on the at least part of the power supply signal lines L in the pixel regions 200, and then converting, by the digital-to-analog conversion unit 104, the digital average value of the currents into an analog compensating voltage for compensating the voltage drops on the power supply signal lines L.

Third Embodiment

This embodiment provides a display device comprising a plurality of sub-pixel units, a driving power supply and the driving circuit of pixel unit provided by the first embodiment. The driving power supply is electrically connected to the sub-pixel units A through power supply signal lines L and configured to provide a driving voltage VDD to the sub-pixel units A through the power supply signal lines L. The driving circuit of pixel unit is connected to the power supply signal lines L through a driving power supply signal port provided thereon, and configured to process the driving voltage VDD output from the driving power supply, then output the processed driving voltage to the power supply signal lines L through the driving power supply signal port and further transfer the processed driving voltage to each of the sub-pixel units A so as to provide a driving signal to each of the sub-pixel units A. The compensation unit 100 in the driving circuit of pixel unit is configured to perform real-time compensation on voltage drops on the power supply signal lines L when the sub-pixel units A display different gray levels so as to provide the compensated driving voltage to each of the sub-pixel units A.

The display device may be applied to mobile phones, Tablet PCs, TV sets, displays, notebook computers, digital photo frames, navigators and other products or components having a display function.

As the display device provided by this embodiment has the driving circuit of pixel unit provided by the first embodiment, the display effect becomes good.

In addition, the display device provided by this embodiment may further comprise other conventional structures, such as a power supply unit, a display driving unit and so on.

It should be understood that the foregoing implementations are merely exemplary implementations used for describing the principle of the present invention, but the present invention is not limited thereto. Those of ordinary skill in the art may make various variations and improvements without departing from the spirit and essence of the present invention, and these variations and improvements shall fall into the protection scope of the present invention.

The invention claimed is:

1. A driving circuit of pixel unit, configured to drive sub-pixel units on a display panel and comprising a power supply port connected to the sub-pixel units through power supply signal lines, the power supply port being configured to transfer a power supply voltage, which is output by a power supply and distinguished from a data voltage, to each of the sub-pixel units through the power supply signal lines, wherein the display panel comprises a plurality of pixel regions, each of the plurality of pixel regions comprising a plurality of subpixel units, each of the power supply signal lines has a first terminal and a second terminal with no circuit element connected therebetween, the first terminal being connected to the power supply port, and the second terminal being connected to one of the subpixel units, the driving circuit of pixel unit further comprises a plurality of compensation units, each of the plurality of compensation units corresponding to one of the plurality of pixel regions and being configured to, acquire, when the sub-pixel units in the one of the plurality of pixel regions display different gray levels according to different data voltages, an average value of currents on at least part of the power supply signal lines according to current values, acquired through the second terminals of the power supply signal lines, on the at least part of the power supply signal lines in the one of the plurality of pixel regions, and then convert the average value of the currents into a compensating voltage, transfer the compensating voltage to the power supply signal lines in the one of the plurality of pixel regions and apply the compensating voltage to the first terminals of the power supply signal lines connected to the subpixel units of the one of the plurality of pixel regions, to compensate the voltage drop on each of the power supply signal lines in the one of the plurality of pixel regions.

2. The driving circuit of pixel unit according to claim 1, wherein the driving circuit of pixel unit further comprises a plurality of current sampling units, each of the pixel regions is provided with a portion of the plurality of current sampling units therein, and the compensation unit comprises a controller unit electrically connected to the current sampling units, wherein the current sampling units are configured to detect current values on at least part of the power supply signal lines in the pixel region and transfer the detected current values to the controller unit; and the controller unit is configured to operate the current values detected by the current sampling units to obtain an average value of the currents on the detected power supply signal lines in the pixel region, and then convert the average value of the currents into a corresponding compensating voltage for compensating the voltage drops on all the power supply signal lines in the pixel region.

3. The driving circuit of pixel unit according to claim 1, wherein the driving circuit of pixel unit further comprises a plurality of current sampling units, each of the pixel regions is provided with at least one current sampling unit therein, and the compensation unit comprises a controller unit electrically connected to the current sampling units, wherein the current sampling units are configured to detect current values on at least part of the power supply signal lines in the pixel regions and transfer the detected current values to the controller unit; and the controller unit is configured to operate the current values detected by the current sampling units disposed in the pixel region and the current values detected by the current sampling units disposed near the pixel region to obtain an average value of the currents on the detected power supply signal lines, and then convert the average value of the currents into a corresponding compensating voltage for compensating the voltage drops on all the power supply signal lines in the pixel region.

4. The driving circuit of pixel unit according to claim 2, wherein the compensation unit further comprises an analog-to-digital conversion unit and a digital-to-analog conversion unit, wherein the analog-to-digital conversion unit is connected between the current sampling units and the controller unit and configured to convert the current values detected by the current sampling units into digital values and then transfer the digital values to the controller unit; and the digital-to-analog conversion unit is connected between the controller unit and the power supply signal lines and configured to convert a digital average value of the currents operated by the controller unit into an analog compensating voltage for compensating the voltage drops on the power supply signal lines.

5. The driving circuit of pixel unit according to claim 3, wherein the compensation unit further comprises an analog-to-digital conversion unit and a digital-to-analog conversion unit, wherein the analog-to-digital conversion unit is connected between the current sampling units and the controller unit and configured to convert the current values detected by the current sampling units into digital values and then transfer the digital values to the controller unit; and the digital-to-analog conversion unit is connected between the controller unit and the power supply signal lines and configured to convert a digital average value of the currents operated by the controller unit into an analog compensating voltage for compensating the voltage drops on the power supply signal lines.

6. The driving circuit of pixel unit according to claim 2, wherein the controller unit is a microprocessor or a programmable logic device.

7. The driving circuit of pixel unit according to claim 3, wherein the controller unit is a microprocessor or a programmable logic device.

8. The driving circuit of pixel unit according to claim 1, wherein the pixel unit driving unit further comprises current lead lines, and each of the sub-pixel units at least comprises a driving transistor and an organic electroluminescent device connected to a drain of the driving transistor, wherein the driving transistor is disposed on a substrate;

the current lead line is disposed below the driving transistor, the current lead line is connected to the drain of the driving transistor, and the current lead line is configured to feed back the current output from the drain of the driving transistor to the compensation unit; and the compensation unit compensates the voltage drop on the power supply signal line according to the value of the current.

9. A driving method for a driving circuit of pixel unit, the driving circuit of pixel unit being configured to drive sub-pixel units on a display panel and comprising a power supply port connected to the sub-pixel units through power supply signal lines and a plurality of compensation units, the power supply port being configured to transfer a power supply voltage, which is output by a power supply and distinguished from a data voltage, to each of the sub-pixel units through the power supply signal lines, the display panel comprising a plurality of pixel regions, each of the pixel regions including a plurality of sub-pixel units and corresponding to one compensation unit, each of the power supply signal lines has a first terminal and a second terminal with no circuit element connected therebetween, the first terminal being connected to the power supply port, and the second terminal being connected to one of the subpixel units, wherein the driving method of the driving circuit of pixel unit comprises: performing, by the compensation unit, real-time compensation on voltage drops on the power supply signal lines for connecting the power supply port to the sub-pixel units when the sub-pixel units display different gray levels, wherein the performing real-time compensation comprises acquiring, when the sub-pixel units in the one of the plurality of pixel regions display different gray levels according to different data voltages, an average value of currents on at least part of the power supply signal lines according to current values on the at least part of the power supply signal lines in corresponding pixel region, and converting the average value of the currents into a compensating voltage and transferring the compensating voltage to the power supply signal lines in the corresponding pixel region, to compensate the voltage drop on each of the power supply signal lines in the corresponding pixel region.

10. The driving method according to claim 9, wherein the driving circuit of pixel unit comprises a plurality of current sampling units, each of the pixel regions is provided with a portion of the plurality of current sampling units therein, and the compensation unit comprises a controller unit electrically connected to the current sampling units, wherein the step of performing, by the compensation unit, real-time compensation on voltage drops on the power supply signal lines for connecting the power supply port to the sub-pixel units when the sub-pixel units display different gray levels comprises:

detecting, by the current sampling units, current values, acquired through the second terminals of the power supply signal lines, on at least part of the power supply signal lines in the pixel region and transferring the detected current values to the controller unit; and operating, by the controller unit, the current values detected by the current sampling units disposed in the pixel region to obtain an average value of the currents on the detected power supply signal lines in the pixel region, and then converting the average value of the currents into a corresponding compensating voltage for compensating the voltage drop on each of the power supply signal lines in the pixel region, and applying the compensating voltage to the first terminal of each of the power supply signal lines.

11. The driving method according to claim 9, wherein the driving circuit of pixel unit comprises a plurality of current sampling units, each of the pixel regions is provided with at least one current sampling unit therein, and the compensation unit comprises a controller unit electrically connected to the current sampling units, wherein the step of performing, by the compensation unit, real-time compensation on voltage drops on the power supply signal lines for connecting the power supply port to the sub-pixel units when the sub-pixel units display different gray levels comprises:

detecting, by the current sampling units, current values on at least part of the power supply signal lines in the pixel region and transferring the detected current values to the controller unit; and operating, by the controller unit, the current values detected by the current sampling units disposed in the pixel region and the current values detected by the current sampling units disposed near the pixel region to obtain an average value of the currents on the detected power supply signal lines, and then converting the average value of the currents into a corresponding compensating voltage for compensating the voltage drop on each of the power supply signal lines in the pixel region.

12. The driving method according to claim 10, wherein the compensation unit further comprises: an analog-to-digital conversion unit connected between the current sampling units and the controller unit, and a digital-to-analog conversion unit connected between the controller unit and the power supply signal lines, wherein the step of detecting, by the current sampling units, current values on at least part of the power supply signal lines and transferring the detected current values to the controller unit comprises: detecting, by the current sampling units, current values on at least part of the power supply signal lines, and converting, by the analog-to-digital conversion unit, the current values into digital values and transferring the digital values to the controller unit; and the step of providing, by the controller unit, a corresponding compensating voltage according to the current values detected by the current sampling units for compensating the voltage drops on the power supply signal lines comprises: operating, by the controller unit, the received digital current values to obtain a digital average value of the currents on at least part of the power supply signal lines in the pixel region, and then converting, by the digital-to-analog conversion unit, the digital average value of the currents into an analog compensating voltage for compensating the voltage drops on the power supply signal lines.

13. The driving method according to claim 11, wherein the compensation unit further comprises: an analog-to-digital conversion unit connected between the current sampling units and the controller unit, and a digital-to-analog conversion unit connected between the controller unit and the power supply signal lines, wherein the step of detecting, by the current sampling units, current values on at least part of the power supply signal lines and transferring the detected current values to the controller unit comprises: detecting, by the current sampling units, current values on at least part of the power supply signal lines, and converting, by the analog-to-digital conversion unit, the current values into digital values and transferring the digital values to the controller unit; and the step of providing, by the controller unit, a corresponding compensating voltage according to the current values detected by the current sampling units for compensating the voltage drops on the power supply signal lines comprises: operating, by the controller unit, the received digital current values to obtain a digital average value of the currents on at least part of the power supply signal lines in the pixel region, and then converting, by the digital-to-analog conversion unit, the digital average value of the currents into an analog compensating voltage for compensating the voltage drops on the power supply signal lines.

14. A display device, comprising a plurality of sub-pixel units, a power supply and a driving circuit of pixel unit configured to drive the sub-pixel units on a display panel, wherein the power supply is electrically connected to the sub-pixel units through power supply signal lines and configured to provide a power supply voltage, which is output by a power supply and distinguished from a data voltage, to the sub-pixel units through the power supply signal lines;

the driving circuit of pixel unit is connected to the power supply signal lines through a power supply port provided thereon, and configured to process the power supply voltage output from the power supply, then output the processed power supply voltage to the power supply signal lines through the power supply port and further transfer the processed power supply voltage to each of the sub-pixel units, to provide a driving signal to each of the sub-pixel units;

the display panel comprises a plurality of pixel regions, each of the pixel regions includes a plurality of sub-pixel units and corresponds to one compensation unit;

the compensation unit is configured to perform real-time compensation on voltage drops on the power supply signal lines when the sub-pixel units display different gray levels, to provide compensated power supply voltage to each of the sub-pixel units;

each of the power supply signal lines has a first terminal and a second terminal with no circuit element connected therebetween, the first terminal being connected to the power supply port, and the second terminal being connected to one of the subpixel units; and the compensation unit is configured to acquire, when the sub-pixel units in the one of the plurality of pixel regions display different gray levels according to different data voltages, an average value of currents on at least part of the power supply signal lines according to current values, acquired through the second terminals of the power supply signal lines, on the at least part of the power supply signal lines in corresponding pixel region, and then convert the average value of the currents into a compensating voltage, transfer the compensating voltage to the power supply signal lines in the corresponding pixel region and apply the compensating voltage to the first terminals of the power supply signal lines connected to the subpixel units of the one of the plurality of pixel regions, to compensate the voltage drop on each of the power supply signal lines in the corresponding pixel region.

15. The display device according to claim 14, wherein the driving circuit of pixel unit further comprises a plurality of current sampling units, each of the pixel regions is provided with a portion of the plurality of current sampling units therein, and the compensation unit comprises a controller unit electrically connected to the current sampling units, wherein the current sampling units are configured to detect current values on at least part of the power supply signal lines in the pixel region and transfer the detected current values to the controller unit; and the controller unit is configured to operate the current values detected by the current sampling units to obtain an average value of the currents on the detected power supply signal lines in the pixel region, and then convert the average value of the currents into a corresponding compensating voltage for compensating the voltage drops on all the power supply signal lines in the pixel region.

16. The display device according to claim 14, wherein the driving circuit of pixel unit further comprises a plurality of current sampling units, each of the pixel regions is provided with at least one current sampling unit therein, and the compensation unit comprises a controller unit electrically connected to the current sampling units, wherein the current sampling units are configured to detect current values on at least part of the power supply signal lines in the pixel regions and transfer the detected current values to the controller unit; and the controller unit is configured to operate the current values detected by the current sampling units disposed in the pixel region and the current values detected by the current sampling units disposed near the pixel region to obtain an average value of the currents on the detected power supply signal lines, and then convert the average value of the currents into a corresponding compensating voltage for compensating the voltage drops on all the power supply signal lines in the pixel region.

17. The display device according to claim 14, wherein the pixel unit driving unit further comprises current lead lines, and each of the sub-pixel units at least comprises a driving transistor and an organic electroluminescent device connected to a drain of the driving transistor, wherein the driving transistor is disposed on a substrate;

the current lead line is disposed below the driving transistor, the current lead line is connected to the drain of the driving transistor, and the current lead line is configured to feed back the current output from the drain of the driving transistor to the compensation unit; and the compensation unit compensates the voltage drop on the power supply signal line according to the value of the current.

* * * * *